US009633829B2

(12) United States Patent
Tagawa et al.

(10) Patent No.: US 9,633,829 B2
(45) Date of Patent: Apr. 25, 2017

(54) DISCHARGE LAMP

(71) Applicant: USHIO DENKI KABUSHIKI KAISHA, Tokyo (JP)

(72) Inventors: Yukiharu Tagawa, Himeji (JP); Tomoyoshi Arimoto, Himeji (JP); Mitsuo Funakoshi, Himeji (JP); Yukio Yasuda, Himeji (JP); Yuki Otoshima, Himeji (JP); Hirohisa Iwabayashi, Himeji (JP)

(73) Assignee: USHIO DENKI KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/900,429

(22) PCT Filed: Jun. 17, 2014

(86) PCT No.: PCT/JP2014/065965

§ 371 (c)(1),
(2) Date: Dec. 21, 2015

(87) PCT Pub. No.: WO2014/208393

PCT Pub. Date: Dec. 31, 2014

(65) Prior Publication Data

US 2016/0155625 A1 Jun. 2, 2016

(30) Foreign Application Priority Data

Jun. 25, 2013 (JP) ..... 2013-132446
Jul. 29, 2013 (JP) ..... 2013-156308
Jan. 29, 2014 (JP) ..... 2014-013921

(51) Int. Cl.
*H01J 17/04* (2012.01)
*H01J 61/073* (2006.01)

(52) U.S. Cl.
CPC ..... *H01J 61/0737* (2013.01); *H01J 61/0732* (2013.01); *H01J 61/0735* (2013.01)

(58) Field of Classification Search
CPC . H01J 61/0737; H01J 61/0735; H01J 61/0732
(Continued)

(56) References Cited

U.S. PATENT DOCUMENTS 7,279,839 B2 10/2007 Menzel et al.
8,695,682 B2 4/2014 Lin

FOREIGN PATENT DOCUMENTS

JP H09-306431 A 11/1997
JP 2732452 B2 3/1998
(Continued)

OTHER PUBLICATIONS

International Search Report—PCT/JP2014/065965 dated Jul. 15, 2014.

(Continued)

*Primary Examiner* — Vip Patel
(74) *Attorney, Agent, or Firm* — Studebaker & Brackett PC

(57) ABSTRACT

A discharge lamp includes an emitter other than thorium, which is added to a cathode in a luminous tube. Early depletion of the emitter due to excessive vaporization of the emitter from the cathode is prevented, while achieving stable lighting even at the start-up of the lighting. A main body part (31) of the cathode (3) is made from a high-melting-point metal material that contains no thorium, and a front end part (32) thereof is made from a high-melting-point metal material that contains an emitter (other than thorium). A sintered compact (34), which contains an emitter (other than thorium) at a concentration higher than the emitter contained in the front end part (32), is buried in a sealed space (33) that is formed within the main body part
(Continued)

(31) and/or the front end part (32). The sintered compact (34) abuts against the front end part (32).

8 Claims, 9 Drawing Sheets

(58) Field of Classification Search
USPC ..... 313/633, 632, 631
See application file for complete search history.

(56) References Cited

FOREIGN PATENT DOCUMENTS

| | | | |
|---|---|---|---|
| JP | 2000-156198 | A | 6/2000 |
| JP | 3175592 | B2 | 6/2001 |
| JP | 2002-141018 | A | 5/2002 |
| JP | 2005-519435 | A | 6/2005 |
| WO | 03075310 | A1 | 9/2003 |

OTHER PUBLICATIONS

The extended European search report issued by the European Patent Office on May 17, 2016, which corresponds to European Patent Application No. 14817580.5-1556 and is related to U.S. Appl. No. 14/900,429.

DISCHARGE LAMP

TECHNICAL FIELD

The present invention relates to discharge lamps that includes a cathode and an emitter contained in the cathode for enabling satisfactory electron emission, and in particular, to a discharge lamp that contains an emitter made from a rare earth element and the like other than thorium.

BACKGROUND ART

Generally, in a high input and high luminance discharge lamp, and the like, an emitter is added to a cathode to facilitate the electron emission. Thorium oxide is conventionally used for the emitter. However, thorium is a radioactive substance and has various restrictions in handling. Thus, use of rare earth elements and compounds thereof as an alternative substance of thorium has been proposed. The rare earth element is a substance that has a low work function ("work function" generally means energy required when an electron is released outward from the interior of the substance) and that excels in electron emission. The rare earth element is expected to serve as an alternative substance of thorium.

Japanese Patent Application Laid-Open Publication No. 2005-519435 (Patent Literature Document 1) discloses a discharge lamp in which lanthanum oxide ($La_2O_3$), hafnium oxide ($HfO_2$), zirconium oxide ($ZrO_2$), or the like is additionally contained, as an emitter, in tungsten, which is the material of the cathode.

The rare earth oxide such as lanthanum oxide ($La_2O_3$), however, has a higher vapor pressure than thorium oxide ($ThO_2$), and thus vaporizes relatively easily. Therefore, if the rare earth oxide is used, in place of the thorium oxide, for the emitter to be contained in the cathode, the rare earth oxide may be excessively vaporized by the lighting lamp, and a situation of early depletion may arise. If the emitter is depleted, the electron emission function in the cathode is lost, thus causing flickers and shortening the life of the lamp.

The emitter contained in the cathode is less likely to be rapidly transported from the rear portion toward the front end of the cathode, and hence the fact that the emitter actually contributing to the electron emission only exists at the front end of the cathode may be one reason for the emitter depletion.

Currently, therefore, the discharge lamp that uses the emitter substance other than thorium still suffers from problems such as the lighting becoming unstable at an early stage. Particularly, in the high input discharge lamp of greater than or equal to 1 kW, it is significant that the early vaporization of rare earth elements and barium-based substances results in unstable lighting of the discharge lamp.

Japanese Patent Application Laid-Open Publication No. 2002-141018 (Patent Literature Document 2) discloses a cathode structure in which an alkali earth metal (oxide) is used for an emitter substance. FIG. 15 of the accompanying drawings shows such cathode structure. Specifically, an easy electron emission part 81 added with alkali earth metal oxide, as an emitter, is embedded in a cathode 80, and exposed at a front end of the cathode.

The alkali earth metal oxide, which is the emitter, is exposed to an arc in such structure as well, and the vaporization of the emitter is facilitated. This is similar to the cathode described in Patent Literature Document 1. As a result, similar problems arise, particularly at the front end of the cathode, in that the emitter is depleted at an early stage and the electron emission function in the cathode is lost. This causes flickers and shortens the longevity of the lamp.

LISTING OF REFERENCES

Patent Literature Documents

PATENT LITERATURE DOCUMENT 1: Japanese Patent Application Laid-Open Publication No. 2005-519435

PATENT LITERATURE DOCUMENT 2: Japanese Patent Application Laid-Open Publication No. 2002-141018

SUMMARY OF THE INVENTION

Problems to be Solved by the Invention

In light of the problems of the prior art, the present invention aims to provide a discharge lamp that includes a cathode and an anode facing each other in an arc tube or luminous tube, and that has a structure configured to prevent early depletion of the emitter and maintain the electron emission function for a long time even if an emitter other than thorium is added to the cathode. The discharge lamp has a longer life with regard to the flicker, and excels in starting property and lighting property at the time of start-up of the lighting.

Solution to the Problems

In order to solve the above-described problems, the present invention provides a cathode that includes a main body part and a front end part joined to a front end of the main body part. The main body part is made from a high melting point metal material including no thorium. The front end part is made from a high melting point metal material containing an emitter (excluding thorium). The sintered compact material is buried or embedded in a hermetically sealed space formed in the main body part and/or the front end part. The sintered compact material contains an emitter (excluding thorium) at a concentration higher than that of the emitter contained in the front end part. The sintered compact material is brought into contact with the front end part.

A pressing member may be arranged on a rear end of the sintered compact material in the hermetically sealed space such that the pressing member may press the sintered compact material toward the front end part.

The pressing member may be made from a high melting point material that has a greater expansion rate than the main body part and the front end part.

The pressing member may be a spring-shaped member, and may be made from a high melting point metal such as tungsten (W), tantalum (Ta), niobium (Nb), molybdenum (Mo), rhenium (Re), osmium (Os) or iridium (Ir), or an alloy thereof.

The sintered compact material may include a tapered portion, and a diameter of the tapered portion may increase toward the front end part.

A projection extending in a circumferential direction of the sintered compact material may be formed on an outer surface of the sintered compact material, and a recess extending in a circumferential direction may be formed on an inner surface of the hermetically sealed space. The projection and the recess may engage with each other.

The projection on the outer surface of the sintered compact material may be a male screw, and the recess on the inner surface of the hermetically sealed space may be a female screw. The male screw may threadedly engage with the female screw.

Advantageous Effects of the Invention

According to the present invention, the front end part containing the emitter other than thorium is joined to the front end of the main body part containing no thorium, and the sintered compact material containing the emitter (excluding thorium) at a concentration higher than that of the emitter contained in the front end part is buried in the hermetically sealed space formed in the main body part and/or the front end part. Thus, when initially turning the discharge lamp on, satisfactory starting property and lighting property are obtained because the front end part is covered with the emitter (excluding thorium) contained in the front end part.

The emitter originally contained in the front end part is consumed as the lighting time elapses, but the emitter is not depleted at the front end part and satisfactory lighting is stably maintained for a long period of time since the emitter is diffused toward the front end part from the sintered compact material containing high concentration of emitter in the cathode.

Since the sintered compact material is buried in the cathode, the sintered compact material is not directly exposed to the discharge arc. Thus, it is unlikely that the sintered compact material is overheated by the arc. Accordingly, the emitter is not depleted at an early stage by excessive vaporization.

The emitter in the sintered compact material smoothly diffuses toward the front end part since the sintered compact material is in contact with the front end part.

With the arrangement of the pressing member on the rear end (lower end) of the sintered compact material, the pressing force acting toward the front end part constantly acts on the sintered compact material. Thus, the formation of a gap between the front end of the sintered compact material and the front end part is prevented and the formation of cracks in the sintered compact material is prevented even if the sintering of the sintered compact material advances and the sintered compact material shrinks due to the high temperature during the lighting.

As the sintered compact material has the tapered portion, the sintered compact material expands mainly toward the front end part when the sintered compact material is thermally expanded. Thus, the front end face of the sintered compact material and the front end part are joined by sintering, and a gap is not formed between the front end face and the front end part even if the sintered compact material shrinks.

Accordingly, the emitter diffuses more smoothly and reliably from the sintered compact material toward the front end part.

Since the sintered compact material is engaged with the hermetically sealed space (closed space) by the projection and the recess, the sintered compact material and the hermetically sealed space are brought into contact at some locations of the projection and the recess even if the sintered compact material expands or shrinks due to temperature fluctuation. Thus, the diffusion path of the emitter from the sintered compact material to the front end part or to the front end part through the main body part is always ensured.

DESCRIPTION OF EMBODIMENTS

Figure 1:
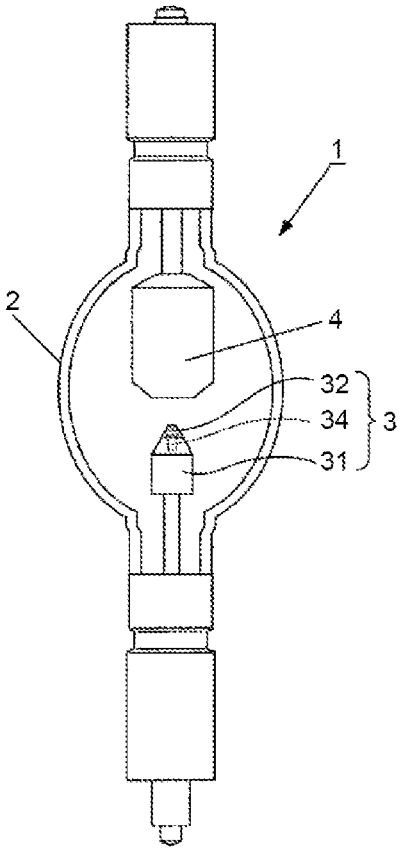
FIG. 1 is an overall view of a discharge lamp having a cathode structure according to an embodiment of the present invention.

FIG. 1 shows an overall structure of a discharge lamp having a cathode structure according to a first embodiment of the present invention. A discharge lamp 1 has a cathode 3 and an anode 4 arranged facing each other in an arc tube (luminous tube) 2.

Figure 2:
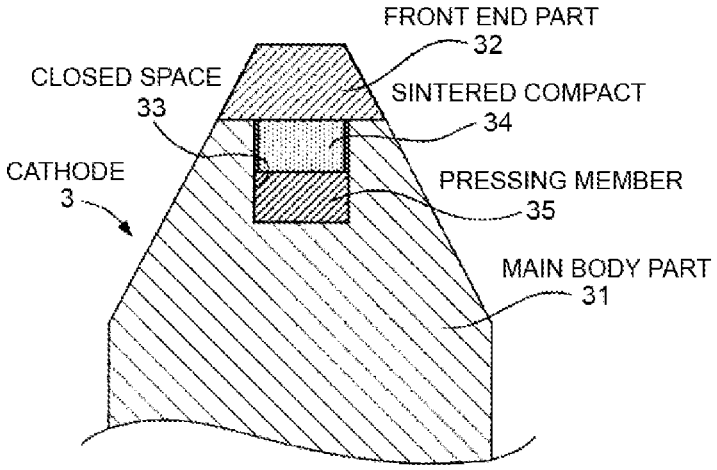
FIG. 2 shows a configuration of a cathode according to a first example of a first embodiment of the present invention.

As shown in detail in FIG. 2, the cathode 3 includes a main body part 31, and a front end part 32 joined to a front end (upper end) of the main body part 31.

The main body part 31 is made from a high melting point metal material such as tungsten and molybdenum, not including thorium.

The front end part 32 is joined to a front end of the main body part 31, i.e., to a surface facing an anode 4, by an appropriate joining method such as a solid phase bonding, resistance welding, and the like. The front end part 32 contains an appropriate amount of emitter, other than thorium, (hereinafter, the emitter contained in the front end part is referred to as a first emitter).

Examples of the first emitter other than thorium may include lanthanum oxide ($La_2O_3$), cerium oxide ($CeO_2$), gadolinium oxide ($Gd_2O_3$), samarium oxide ($Sm_2O_3$), praseodymium oxide ($Pr_6O_{11}$), neodymium oxide ($Nd_2O_3$), yttrium oxide ($Y_2O_3$), or a combination thereof.

The first emitter is provided to ensure the starting property and the lighting property at the start-up lighting of the lamp. The concentration of the first emitter is set relatively low, e.g., from 0.5 weight % to 5.0 weight %. The concentration is set relatively low in order to prevent the emitter from being exposed to the discharge arc and excessively vaporizing.

Specifically, if the amount of the first emitter contained is less than 0.5 weight %, the emitter concentration required for the electron emission at the beginning of lighting cannot be ensured, and the lamp voltage rises and/or the fluctuation of the lamp voltage increases. If the amount of the first emitter contained is greater than 5.0 weight %, a sintered compact material becomes fragile in the manufacturing process with a tungsten material, and the like, and breakage caused by cracks in the sintering process and the swage process easily occurs. Furthermore, even if manufactured, the vaporization of the emitter becomes significant when the emitter is used at the front end part thus promoting blackening (clouding) of a bulb. This is not preferable.

As shown in FIG. 2, a hermetically sealed space (closed space) 33 is formed in the cathode 3, and a sintered compact material 34 containing the emitter is buried in the hermetically sealed space 33.

The emitter sintered compact material 34 contains an emitter (hereinafter, the emitter contained in the sintered compact material 34 is also referred to as a second emitter) other than thorium. Specific examples of such emitter include lanthanum oxide ($La_2O_3$), cerium oxide ($CeO_2$), gadolinium oxide ($Gd_2O_3$), samarium oxide ($Sm_2O_3$), praseodymium oxide ($Pr_6O_{11}$), neodymium oxide ($Nd_2O_3$), yttrium oxide ($Y_2O_3$), or a combination thereof. This is similar to the first emitter.

The concentration of the second emitter contained in the sintered compact material 34 is set to be higher than that of the first emitter contained in the front end part 32. The concentration of the second emitter is, for example, from 10 weight % to 80 weight %.

If the concentration of the second emitter is less than 10 weight %, it is difficult to supply a sufficient amount of emitter to the front end part 32 of the cathode within a lamp lifespan time because of the size of the sintered compact material 34 that can be received (embedded) in the cathode 3. If the concentration of the second emitter is greater than 80 weight %, the ratio of the constituting material, such as tungsten, of the sintered compact material 34 decreases, and the product obtained through the reduction of oxides reduces. Thus, in either case, the longevity of the cathode is shortened.

According to such cathode structure, satisfactory starting property and lighting property are achieved by covering the front end part with the emitter (excluding thorium) disposed in the front end part when initially turning the discharge lamp on.

The emitter originally contained in the front end part is consumed as the lighting time passes. However, the emitter is not depleted at the front end part since the emitter diffuses and arrives at the front end part from the sintered compact material that contains the emitter at a high concentration in the cathode. Thus, satisfactory lighting property is stably maintained for a long period of time.

Furthermore, since the sintered compact material is embedded in the cathode, the sintered compact material is not directly exposed to the discharge arc and is not overheated by the arc. Thus, the emitter is not excessively vaporized and hence is not depleted at an early stage.

Therefore, when the cathode structure of the embodiment of the present invention is employed, the discharge lamp that uses the cathode containing the emitter other than thorium can be realized.

It was found that when the discharge lamp having such cathode structure was actually lit, a crack rarely formed in the sintered compact material, and a gap formed between the sintered compact material and the front end part depending on the lighting conditions.

Figures 14A, 14B, 14C:
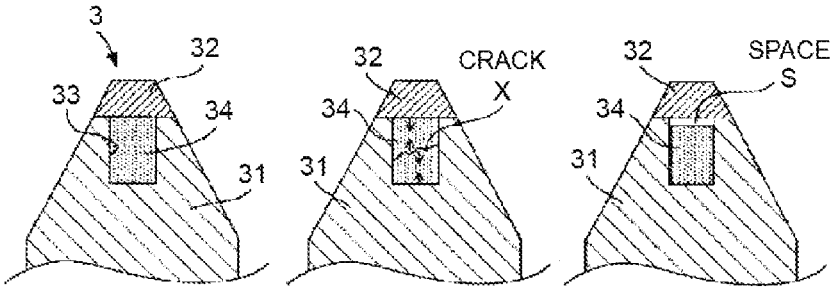
FIG. 14(A) to FIG. 14(C) are a set of views useful to describe technical problems to be overcome by the present invention.
Figure 15:
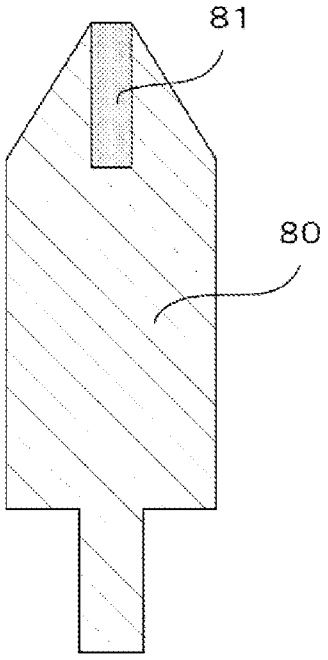
FIG. 15 is a cross-sectional view of a conventional structure.

This will be described below with reference to FIGS. 14(A) to 14(C). FIG. 14(A) shows a cathode structure, which serves as a premise of the present invention. The cathode 3 includes the main body part 31 and the front end part 32 joined to the main body part 31. The sintered compact material 34 is buried in the cathode 3.

When the discharge lamp having such cathode structure is lit, a crack X is sometimes generated in the sintered compact material 34, as shown in FIG. 14(B), depending on the lighting conditions and/or other factors.

Such drawback was reviewed in detail. It was presumed that the cause of crack was the advancement in the sintering of the sintered compact material 34 while the lamp was lit. The sintered compact material is sintered at a temperature lower than the sintering temperature of the main body part 31 and the front end part 32 of the cathode 3, which have the same sintered structure as the sintered compact material, in order to avoid the emitter from vaporizing during the sintering process. Thus, the sintering does not advance sufficiently.

However, the sintering advances due to high temperature during the lighting time of the lamp, and shrinkage occurs. In this case, a pulling force acts on the sintered compact material 34 from both ends in an axial direction, and the crack X is assumed to be produced in the sintered compact material 34 when the sintered compact material 34 cannot withstand such force.

Even if the crack is not formed, a gap or space S may be formed between the sintered compact material 34 and the front end part 32 of the cathode by the axial shrinkage of the sintered compact material, which is caused by the advancement of the sintering of the sintered compact material 34, as shown in FIG. 14(C). In some cases, the crack and the space are simultaneously formed. When such crack X and space S are formed, it is difficult for the emitter to diffuse from the sintered compact material 34 to the front end part 32 of the cathode. Thus, the emitter in the sintered compact material cannot be sufficiently utilized, which may result in the depletion of the emitter in the front end of the cathode.

In the present invention, a structure that brings the sintered compact material into contact with the front end part of the cathode is adopted to suppress the insufficiency in diffusion and supply of the emitter due to the generation of the crack and the space between the sintered compact material and the front end part upon the progress of the sintering of the sintered compact material.

This will be described below.

As shown in FIG. 2, a pressing member 35 is arranged at a rear end of the sintered compact material 34 in the hermetically sealed space 33 formed in the main body part 31 of the cathode 3 along with the sintered compact material 34. The sintered compact material 34 is pressed and brought into contact with the front end part 32 by the pressing member 35.

The pressing member 35 has a melting point (for example, melting point is higher than or equal to approximately 2000 degrees C. (2300 degrees K)) higher than an achieving temperature of the cathode 3 during the lighting time of lamp, and is made from a material having a greater linear expansion coefficient than the material of the main body part 31 and the front end part 32 of the cathode 3.

For example, the exemplary material of the main body part 31 and the front end part 32 of the cathode 3 is tungsten. In this case, a metal having a higher linear expansion coefficient than the linear expansion coefficient of the tungsten is used for the pressing member 35. Specifically, a high melting point metal such as tantalum (Ta), niobium (Nb), molybdenum (Mo), rhenium (Re), osmium (Os) and iridium (Ir) or an alloy thereof may be used, or magnesium oxide (MgO), aluminum oxide ($Al_2O_3$), calcium oxide (CaO), zirconium oxide ($ZrO_2$), yttrium oxide ($Y_2O_3$) or hafnium oxide ($HfO_2$) may be used.

When the cathode temperature is caused to rise by the lighting of the lamp, the sintering advances in the emitter sintered compact material 34 and the sintered compact material 34 tends to shrink in the axial direction. However, since the pressing member 35 accommodated in the hermetically sealed space 35 has a greater linear expansion coefficient than the main body part 31 and the front end part 32 of the cathode 3, the pressing member 35 has a greater amount of thermal expansion than the main body part 31 and the front end part 32. As such, the thermal expansion of the pressing member is greater than an amount of shrinkage of the sintered compact material 34. Accordingly, it is possible to keep pressing the sintered compact material 34 toward the front end part 32 and bringing the sintered compact material 34 into contact with the front end part 32. The pulling force does not act on the sintered compact material 34, and no cracks are generated.

Figure 3:
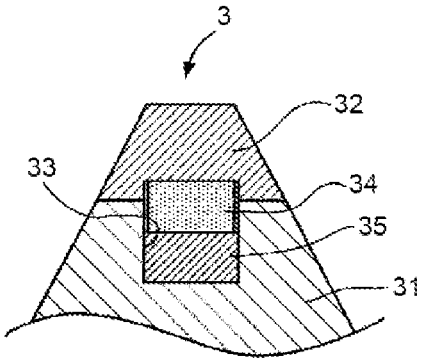
FIG. 3 shows a configuration of a cathode according to a second example of the first embodiment of the present invention.
Figure 4:
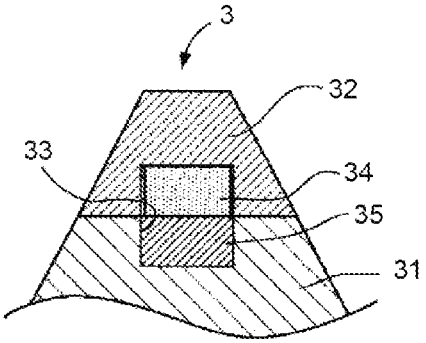
FIG. 4 shows a configuration of a cathode according to a third example of the first embodiment of the present invention.

In FIG. 2, the sintered compact material 34 containing the emitter other than thorium is embedded in the closed space 33 defined in the main body part 31 of the cathode 3, but the present invention is not limited to this configuration. In a second example shown in FIG. 3, the closed space 33 extends across the main body part 31 and the front end part 32, and the sintered compact material 34 is embedded such that the sintered compact material 34 spans the main body part 31 and the front end part 32. In a third example shown in FIG. 4, the closed space 33 is formed in both of the main body part 31 and the front end part 32. This is similar to FIG. 3. The sintered compact material 34 is substantially embedded in the front end part 32 in the third example.

The dimension, particularly the thickness, of the front end part 32 differs depending on which example is used. The selection of one example from the three examples is appropriately made in view of easiness in the manufacturing process, cost that depends on the thickness of the front end part 32, overall manufacturing cost, and the like.

As the sintered compact material 34 is buried in the cathode 3, the sintered compact material 34 is not directly exposed to the discharge arc and is not heated more than necessary. Thus, the second emitter contained in the sintered compact material is not excessively vaporized.

Figure 5A:
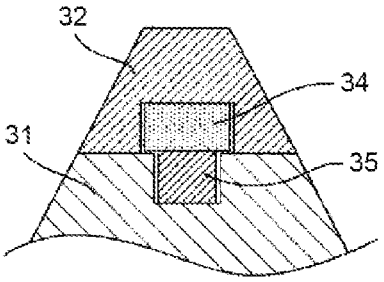
FIG. 5A shows a configuration of a cathode according to a fourth example of the first embodiment.
Figure 5B:
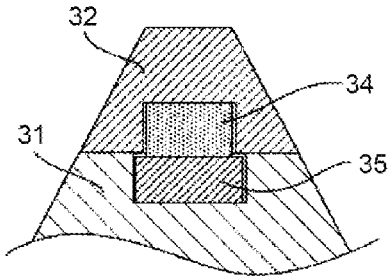
FIG. 5B shows a configuration of a cathode according to a fifth example of the first embodiment.

Further examples, i.e., fourth and fifth examples, are shown in FIGS. 5(A) and 5(B). The diameters of the emitter sintered compact material 34 and the pressing member 35 to be accommodated in the hermetically sealed space 34 are different. Specifically, in the fourth example shown in FIG. 5(A), the diameter of the pressing member 35 is smaller than the sintered compact material 34, and in the fifth example shown in FIG. 5(B), the diameter of the pressing member 35 is greater than the sintered compact material 34.

Figure 6:
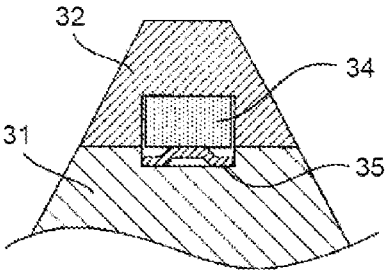
FIG. 6 shows a configuration of a cathode according to a sixth example of the first embodiment.

A sixth example is shown in FIG. 6. The pressing member 35 in the hermetically sealed space 34 has a spring shape. In this case, the material constituting the pressing member 35 is a high melting point metal such as tungsten (W), tantalum (Ta), niobium (Nb), molybdenum (Mo), rhenium (Re), osmium (Os), iridium (Ir), and the like, or an alloy thereof.

A dimension example and a manufacturing method of the cathode structure of the example shown in FIG. 2 will be described below.

<Dimension Example>

Main body part: K doped tungsten

Body diameter of main body part: ϕ10 mm

Front end part: $W+ZrO_2+La_2O_3$ (emitter)

Thickness of front end part: 3 mm

Hermetically sealed space: inner diameter ϕ2.1 mm, depth 4 mm

Sintered compact material: $W+CeO_2$ (emitter)

Dimension of sintered compact material: ϕ2 mm, entire length 2 mm

Pressing member: tantalum

Dimension of pressing member: ϕ2 mm, entire length 2 mm

<Manufacturing Method>

The tungsten (W) powder and the cerium oxide ($CeO_2$) powder are mixed at a ratio of 2:1 in weight ratio, a binder (stearic acid) is added, and then molding is carried out through pressurizing press (approximately 5 MPa). Then, the compression molded article undergoes the grease-removing process and a preliminarily sintering process at a temperature of 1000 degrees C. in a reductive atmosphere, inserted into a vacuum heating furnace, and heated and fired at a temperature of 1500 degrees C. to 1800 degrees C. to manufacture an original form (blank) of the sintered compact material. An end face of the sintered compact material of the original form is cut and shaped to manufacture a sintered compact material having a diameter of approximately Φ2 mm and a length of about 2 mm.

The manufacturing process of the cathode using such sintered compact material will now be described with reference to FIGS. 7(A)-7(C).

Figures 7A, 7B, 7C:
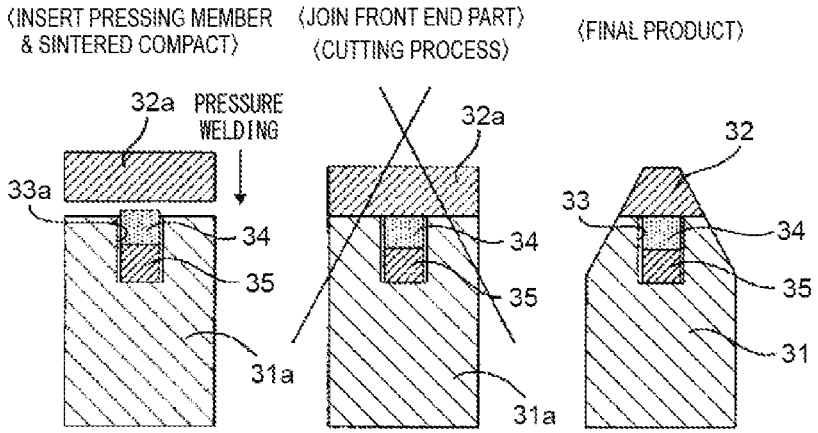
FIG. 7(A) to FIG. 7(C) are a set of views showing a process of fabricating the cathode of the first embodiment of the present invention.

Firstly, as shown in FIG. 7(A), a hole 33*a*, which ultimately become the hermetically sealed space 33, is formed at the front end of a main body member 31*a*, which will ultimately become the main body part 31, and the pressing member 35 and the sintered compact material 34 are inserted into the hole 33*a*. Then, a front end member 32*a*, which will ultimately become the front end part 32, is brought into contact with the sintered compact material 34.

At this point in time, the front end of the sintered compact material 34 projects out from the surface of the main body part 31 by a slight amount of approximately 0.5 mm.

As shown in FIG. 7(B), the front end member 32*a* is pressed to compress the sintered compact material 34, thereby bringing the front end member 32*a* and the main body member 31*a* into contact. The sintered compact material 34 is sintered at a temperature lower than the sintering temperature of the main body part 31 and the front end part 32. Thus, the shrinkage allowance upon pressing is large, and the sintered compact material 34 shrinks only by a slight amount upon the contact of the main body member 31*a* with the front end member 32*a*. The sintered compact material 34 is thereby brought into contact with the front end member 32*a*.

The main body member 31*a* and the front end member 32*a* are joined in this state by diffusion bonding, resistance welding, and the like.

After the front end member 32*a* and the main body member 31*a* are joined to each other, the front end of the cathode 3 undergoes a cutting process.

As a result, the final shape of the cathode 3 is obtained, as shown in FIG. 7(C). Specifically, the front end part 32 is joined to the front end of the main body part 31, and the sintered compact material 34 and the pressing member 35 are sealedly buried in the hermetically sealed space 33 formed in the cathode 3.

It should be noted that the cathode structure according to the first embodiment of the present invention is applied to a short arc type discharge lamp such as a mercury lamp, xenon lamp, and the like in FIG. 1, but the above-described cathode structure may be applied to a long arc type discharge lamp.

As described above, in the first embodiment of the present invention, the hermetically sealed space is formed in the cathode, the cathode includes the main body part and the front end part joined to each other, the sintered compact material containing the emitter other than thorium at a high concentration is accommodated in the hermetically sealed space, and the pressing member is disposed at the lower end of the sintered compact material (at the bottom) in the hermetically sealed space. Thus, the pressing member can press the sintered compact material toward the front end part to bring the sintered compact material into contact therewith even if the sintering of the sintered compact material is advanced by the high temperature from the lighting and the sintered compact material axially shrinks. Thus, the crack is not formed in the sintered compact material, the space is not formed between the sintered compact material and the front end part, and the emitter in the sintered compact material is smoothly conveyed to the front end part. As a consequence, effective utilization of the contained emitter is achieved, and depletion of the emitter does not occur at the front end part.

As described above, the present invention provides the cathode structure that can be practiced and that receives in the cathode the sintered compact material containing the emitter other than thorium at a high concentration.

Now, a second embodiment of the present invention will be described with reference to FIGS. 8 and 9.

Figure 8:
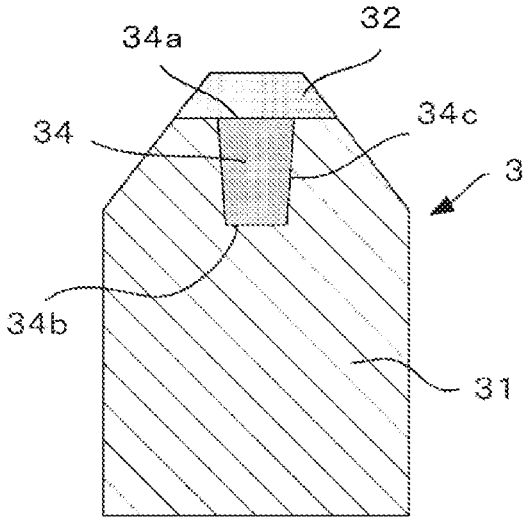
FIG. 8 shows a configuration of a cathode according to a seventh example of a second embodiment of the present invention.

In FIG. 8, the cathode 3 includes, similar to the first embodiment, the main body part 31, the front end part 32 joined to the front end of the main body part 31, and the tapered sintered compact material 34 buried in the main body part 31 such that the sintered compact material 34 extends in the axial direction.

The emitter, other than thorium, contained in each of the front end part 32 and the sintered compact material 34 is similar to that in the first embodiment described in connection with FIG. 2 and the subsequent figures.

The sintered compact material 34 includes a tapered portion 34*c* having a tapered shape in which the diameter enlarges toward the front end part 32. In this example, the entire sintered compact material 34 has a tapered shape. The diameter of a front end face (upper end face) 34*a*, which contacts the front end part 32, is greater than the diameter of a rear end face (lower end face) 34*b*.

A ratio of the diameter of the front end face 34*a* and the diameter of the rear end face 34*b* in the sintered compact material 34 is, for example, from 1.005:1 to 1.2:1.

A distance between the front end face 34*a* of the sintered compact material 34 and the front end face of the cathode (the front end part 32) is, for example, from 1 to 5 mm.

An example of a specific dimension of such cathode 3 is as follows.

The main body part 31 has a maximum outer diameter of 15 mm and an axial length of 60 mm. The front end part 32 has a diameter of 1.2 mm at the front end face thereof and an axial length of 2 mm. An outer diameter of an interface between the main body part 31 and the front end part 32 is 6 mm. The sintered compact material 34 has a diameter of 2.2 mm at the front end face 34*a*, a diameter of 2.0 mm at the rear end face 34*b*, and an axial length of 5 mm.

Such cathode 30 can be basically manufactured in the following manner, similar to the manufacturing method described with reference to FIGS. 7(A)-7(C).

The main body member that has a tapered hole is prepared. The tapered hole will become the hermetically sealed space to receive the sintered compact material 34. The main body member, the front end member, and the sintered compact material 34 having a tapered shape are separately prepared.

The sintered compact material 34 may be manufactured in the following manner. Firstly, a binder such as stearin acid is added to a mixture of powder of a high melting point metal material and powder of an emitter substance to prepare a raw material of the sintered compact material. Then, the sintered compact material is molded by a pressing machine or the like. The resulting molded body is heated in a hydrogen gas atmosphere under the conditions of, for example, processing temperature of 1000 degrees C., and processing time of one hour to carry out the grease-removing process and the preliminary sintering process on the molded body. The sintering process is then carried out on the molded body under a lower pressure, with the processing temperature of, for example, 1400 degrees C to 2000 degrees C., preferably 1500 degrees C. to 1800 degrees C., and the processing time of, for example, one hour to obtain the sintered compact material 34.

The tapered portion of the sintered compact material may be formed using a die with a tapered shape during the pressure molding, or may be formed by the cutting process after the heat treatment applied to the molded body.

The sintered compact material 34 is arranged in the hole of the main body member, and then the front end member is brought into contact therewith to join the front end member with the main body member by diffusion bonding, resistance welding, and the like. The front end member and the main body member joined in such manner are shaped by the cutting process such that the cathode has a desired front end shape.

The reduction process is applied to the resultant cathode member with the hydrogen gas under the conditions of, for example, the processing temperature of 1000 degrees C. and the processing time of 0.5 hour. Thereafter, a vacuum heat treatment is carried out under the conditions of, for example, the processing temperature of 2000 degrees C. to 2400 degrees C., and the processing time of one hour. The desired cathode 30 is thereby obtained.

According to the cathode of the second embodiment of the present invention, the sintered compact material 34 contains the emitter substance at a concentration higher than that of the emitter in the front end part 32, and hence the linear expansion coefficient of the material constituting the sintered compact material 34 is greater than (two to three times as great as) the linear expansion coefficient of the material constituting the main body part 31 and the front end part 32.

The sintered compact material 34 has the tapered portion 34*c*, and the diameter of the tapered portion 34*c* at the front end face 34*a* is greater than the diameter at the rear end face 34*b*. Thus, in the vacuum heat treatment during the manufacturing of the cathode 3 or during the lighting of the discharge lamp, the sintered compact material 34 containing the emitter substance at a concentration higher than that of the emitter in the front end part 32 expands in a greater amount than the main body part 31 and the front end part 32 upon elevation of the temperature.

As the sintered compact material 34 has a tapered shape, the sintered compact material 34 expands mostly toward the front end part during the expansion. Thus, the front end face 34*a* of the sintered compact material 34 is pressed against the front end part 32, the contact becomes stronger between the front end part 32 and the sintered compact material 34, and the front end part 32 and the sintered compact 34 are joined by sintering. This prevents easy separation between the front end part and the sintered compact. Accordingly, even if the sintered compact shrinks, a space is not be formed between the front end face 34*a* of the sintered compact material 34 and the front end part 32, and a sufficient amount of emitter substance is smoothly supplied from the sintered compact material 34 to the front end part 32.

Experimental Example

The cathode having the following specification was fabricated in accordance with the configuration shown in FIG. 8.

Main body part: Material was tungsten doped with zirconium oxide ($ZrO_2$) (concentration of $ZrO_2$ was 1 wt %). Maximum outer diameter was 15 mm, and axial length was 58 mm.

Front end part: Material was tungsten doped with lanthanum oxide ($La_2O_3$) and zirconium oxide ($ZrO_2$) (concentration of $La_2O_3$ was 1.5 wt %, and concentration of $ZrO_2$ was 0.05 wt %). Diameter of front end face was 0.8 mm, outer diameter of interface between the front end part and main body part was 6 mm, and axial length was 2 mm.

Sintered compact material: Material was sintered compact material of cerium oxide ($CeO_2$) and tungsten (W) (mass ratio of $CeO_2$ and W was 1:2). Diameter of front end face was 2.2 mm, diameter of rear end face was 2.0 mm, and axial length was 5 mm.

The discharge lamp having the following specification was prepared according to the configuration shown in FIG. 1 and using the above-described cathode.

Luminous tube: Material was quartz glass, and maximum inner diameter was 109 mm.

Anode: Material was tungsten, outer diameter was 35 mm, and axial length was 65 mm.

Inter-electrode distance: 9 mm

Rated input: 7 kW

The discharge lamp was lit under the conditions of voltage of 35V and current of 200 A. The lighting time until the flicker was generated was measured and was found to be 700 hours. An illuminance preserving factor of the discharge lamp after elapse of 700 hours from the start of lighting was 85%.

Comparative Example

As a comparative example, the sintered compact material was changed to a sintered compact material having a circular column shape with an outer diameter of 2.2 mm and an axial length of 5 mm. The cathode and the discharge lamp were fabricated with the other factors similar to those in the experimental example.

The discharge lamp was lit under the conditions of voltage of 35V and current of 200 A. The lighting time until the flicker was generated was measured and was found to be 500 hours. An illuminance preserving factor of the discharge lamp after elapse of 500 hours from the start of lighting was 85%.

As apparent from the above-mentioned results, it was confirmed that a stable lighting state was achieved by the discharge lamp of the experimental example for a long period of time (700 hours) until the flicker was generated.

On the contrary, in the discharge lamp according to the comparative example, the flicker was generated in 500 hours after the start of lighting and the discharge lamp became unstable in a relatively short period of time. This is assumed to be because the space is formed between the front end part and the sintered compact material due to the shrinkage of the sintered compact material during the lighting, and the emitter substance was not sufficiently supplied from the sintered compact material to the front end part during the lighting of the discharge lamp.

Figure 9:
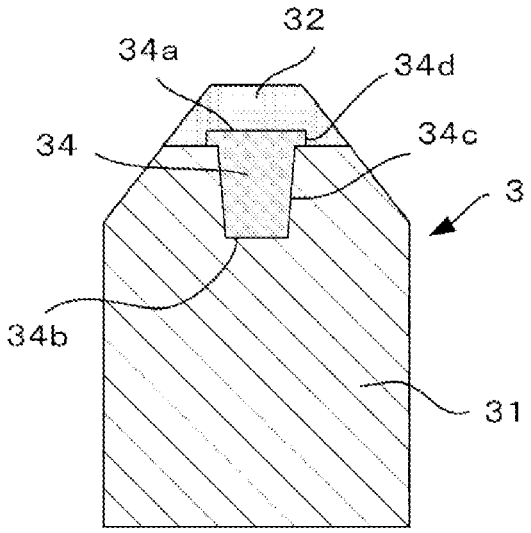
FIG. 9 shows a configuration of a cathode according to an eighth example of the second embodiment of the present invention.

FIG. 9 shows an eighth example in the second embodiment.

In the seventh example shown in FIG. 8, the entire sintered compact material 34 has a tapered shape, whereas in the eighth example, a portion of the sintered compact material 34 has a tapered shape.

Specifically, the sintered compact material 34 includes a front end portion 34*d* having a larger diameter than the tapered portion 34*c*. The front end portion 34*a* is formed on the front end of the tapered portion 34*c*. The diameter of the tapered portion 34*c* increases toward the front end part 32.

In this example, the tapered portion 34*c* is received (embedded) in the main body part 31, and the front end portion 34*d* is received in the front end part 31.

An example of a specific dimension of the eighth example is as follows.

The main body part 31 has a maximum outer diameter of 15 mm and an axial length of 60 mm. The front end part 32 has a diameter of 1.2 mm at the front end face, and an axial length of 3 mm. The diameter of the interface between the main body part 31 and the front end part 32 is 6 mm. The sintered compact material 34 has a diameter of 2.2 mm at the front end portion 34*d*, an axial length of 1 mm, a diameter of 2.0 mm at the front end of the tapered portion 34*c*, a diameter of 1.8 mm at the rear end, and an axial length of 4 mm.

A third embodiment of the present invention will now be described with reference to FIGS. 10(A)-10(C) to FIG. 13.

In the embodiment, a projection and a recess are formed such that the projection and the recess extend in the circumferential direction in the sintered compact material and the hermetically sealed space, respectively. The projection and the recess are engaged with each other.

Figure 10A:
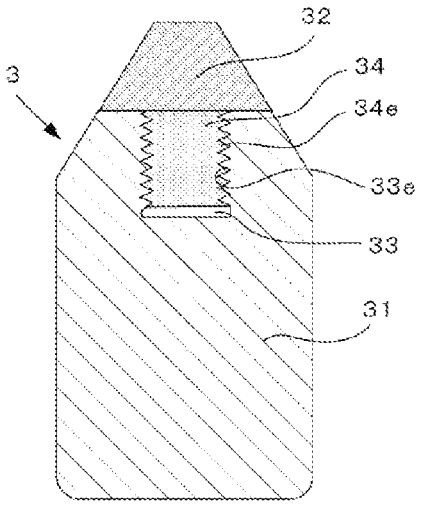
FIG. 10(A) shows a cathode configuration according to a tenth example of a third embodiment of the present invention.
Figure 10B:
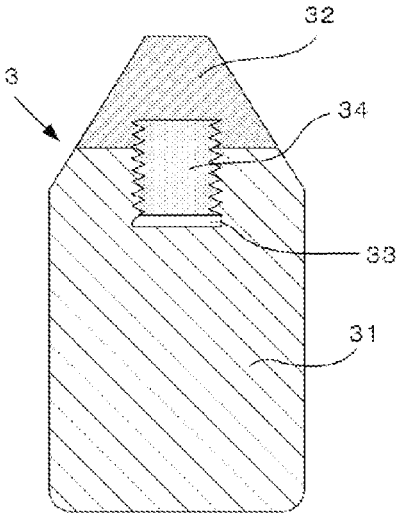
FIG. 10(B) shows a cathode configuration according to an eleventh example of the third embodiment of the present invention.
Figure 10C:
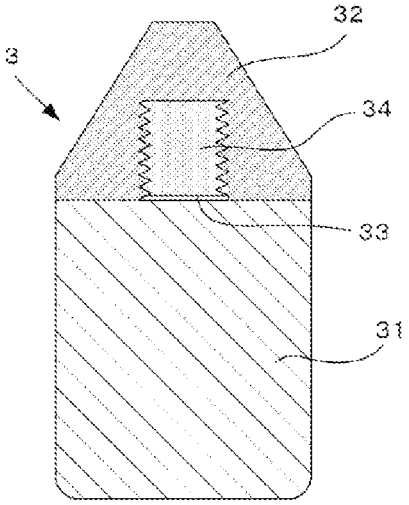
FIG. 10(C) shows a cathode configuration according to a twelfth example of the third embodiment of the present invention.

As shown in FIGS. 10(A)-10(C), the hermetically sealed space 33 is formed in the cathode 3, and the sintered compact material 34 containing the emitter other than thorium is buried in the hermetically sealed space 33.

The overall configuration of each of the cathodes 3 in FIGS. 10(A)-10(C) is basically the same as that shown in FIG. 2, and thus the redundant description will be omitted.

A female screw 33*e* is formed on the inner surface of the hermetically sealed space 33, and a male screw 34*e* is formed on an outer surface of the sintered compact material 34. Such screws are threadedly engaged with to each other.

In FIG. 10(A), the hermetically sealed space 33 is formed in the main body part 31, and the sintered compact material 34 is substantially buried in the main body part 31.

In FIG. 10(B), the hermetically sealed space 33 is formed across the main body part 31 and the front end part 32, and the sintered compact material 34 is buried to cross the main body part 31 and the front end part 32 (extend between the main body part and the front end part).

In FIG. 10(C), the hermetically sealed space 33 is formed in the front end part 32, and the sintered compact material 34 is substantially buried in the front end part 32.

Among the cathode structures according to the third embodiment of the present invention, the manufacturing processes of the structure shown in FIG. 10(A) will be described with reference to FIGS. 11(A) to 11(D).

The sintered compact material 34 to be buried in the closed space 33 defined in the cathode 3 is obtained by mixing the emitter ($CeO_2$) and the tungsten (W) at a compounding ratio of 1:2 in weight ratio, adding the binder (stearin acid) to the mixture, and carrying out molding with a pressing machine. Thereafter, the grease-removing and the preliminary sintering are carried out at a temperature of 1000 degrees C. in hydrogen, and then the sintering in vacuum is carried out in the tungsten furnace at a temperature of 1400 degrees C. to 2000 degrees C., preferably 1500 degrees C. to 1800 degrees C., for one hour to fabricate the sintered compact material 34. It is not preferable to carry out the sintering at a higher temperature than the above-mentioned temperature since the emitter added at a high concentration vaporizes and disappears. If the emitter is lost in this way, the addition of the emitter at a high concentration would become meaningless. After molding, the male screw 34*a* is formed on the outer surface of the sintered compact material 34 by the cutting process.

The main body part 31 of the cathode 3 is made from $ZrO_2$ doped tungsten, and the front end part 32 is made from $La_2O_3$ and $ZrO_2$ doped tungsten. Both of the parts 31 and 32 are subjected to sintering at a temperature of 2300 degrees C. to 2500 degrees C. in vacuum and swaging. It is not preferable to sinter such tungsten, which contains the emitter, at a higher temperature (e.g., 3000 degrees C.) since the emitter vaporizes and disappears.

The female screw 33*a* is formed on the inner surface of the hermetically sealed space 33 formed in the main body part 31 of the cathode 3 by the cutting process.

Figures 11A, 11B, 11C, 11D:
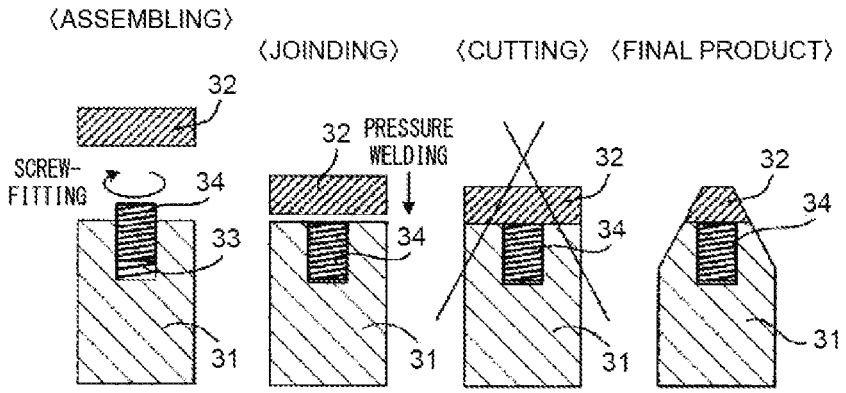
FIG. 11(A) to FIG. 11(D) are a set of views showing a process of fabricating the cathode of the third embodiment of the present invention.

Firstly, as shown in FIG. 11(A), the sintered compact material 34 is screwed into and buried in the hermetically sealed space 33 while screw fitting the male screw 34*e* of the sintered compact material 34 to the female screw 33*e* on the inner surface of the hermetically sealed space 33, which opens toward the front end of the main body part 31.

Then, as shown in FIG. 11(B), the front end part 32 is brought into contact with the main body part 31, and the front end part is joined to the main body part by diffusion bonding, resistance welding or the like while the front end part being pressed against the main body part.

After the front end part 32 and the main body part 31 are joined, the front end of the cathode 3 is subjected to the cutting process to obtain a desired shape, as shown in FIG. 11(C).

Thus, as shown in FIG. 11(D), the final shape of the cathode 3 is obtained. Specifically, the front end part 32 is joined to the front end of the main body part 31, and the sintered compact material 34 is screw fitted and sealably buried in the hermetically sealed space 33 in the cathode 3.

An alternative manufacturing method other than the above-described manufacturing method will be described. The molding process and the sintering process are not applied to the sintered compact material in advance. Rather, a powder is supplied into the hermetically sealed space in the cathode and then a pressure molding process is applied. Subsequently, the molded powder is sintered in the hermetically sealed space.

Specifically, in the main body part and/or front end part, a groove or recess extending in the circumferential direction is formed in advance in the inner surface of the empty hole, which will ultimately become the hermetically sealed space, and a powder of emitter ($CeO_2$) and a powder of tungsten (W), not containing the binder, are mixed with each other and supplied into the empty hole. Then, the pressure molding is performed by the pressing machine. The powder mixture enters (intrudes in) the recess of the empty hole, and forms the projection.

The preliminary sintering is then carried out at a temperature of 1000 degrees C. in hydrogen, and then the sintering is carried out. The sintering is carried out in the tungsten furnace in vacuum at a temperature of 1400 degrees C. to 2000 degrees C., preferably 1500 degrees C. to 1800 degrees C., for one hour. The compounding ratio of the emitter ($CeO_2$) and the tungsten (W) is, for example, 1:2 (weight ratio).

When sintering the sintered compact material by the above-described method, the recess extending in the circumferential direction and formed on the inner wall of the empty hole (hermetically sealed space) may be in a screw form (spiral form) or may have an independent groove shape formed in the circumferential direction.

Figure 12:
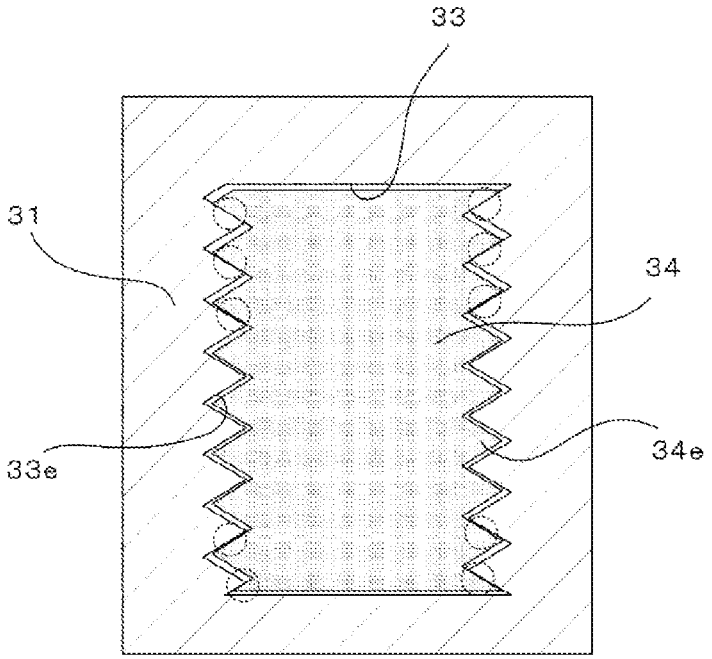
FIG. 12 is an operation explanatory view of the third embodiment.

The function and the role of the main body part 31 and the front end part 32 of the cathode 3 of the embodiment of the present invention, and the function and the role of the sintered compact material 34, which are provided in the above-described manner, will now be described with reference to FIGS. 12 and 13.

As described above, the sintered compact material 34 that contains an emitter at a high concentration is sintered at a temperature lower than the main body part 31 and the front end part 32 in order to avoid vaporization and disappearance of the emitter. Furthermore, the swage process is not carried out, unlike the main body part 31 and the front end part 32. Thus, when the temperature becomes high due to the lighting of the lamp, the sintering advances, the volume of the sintered compact material reduces, and the contact between the sintered compact material and the inner wall surface of the hermetically sealed space 33 tends to become insufficient.

In the embodiment of the present invention, however, the sintered compact material and the inner wall of the hermetically sealed space 33 are threadedly engaged with each other. Thus, even if the sintered compact material 34 is reduced in the axial direction and the radial direction, as can be seen in FIG. 12, the male screw 34*e* of the sintered compact material 34 and the female screw 33*e* of the hermetically sealed space 33 maintain the contact on one of the sides in the axial direction.

Figure 13:
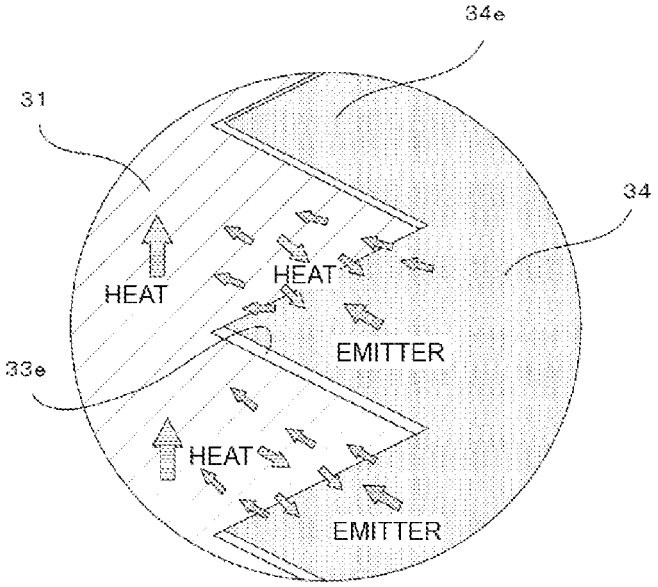
FIG. 13 is a schematic enlarged view of FIG. 12.

Therefore, as shown in FIG. 13, the heat transmission from the main body part 31 (or front end part 32) of the cathode is sufficiently ensured through a contacting surface between the male screw 34*e* and the female screw 33*e*. Accordingly, the diffusion of the emitter from the sintered compact material 34 to the main body part (front end part 32) is ensured without stagnation. The emitter smoothly diffuses from the sintered compact material 34, which contains the high concentration emitter, to the main body 31 and the front end part 32 of the cathode, and transported through the front end part 32 to the front end of the cathode by a grain boundary diffusion. As such, the depletion of the emitter at the front end part 32 does not occur.

This phenomenon takes place in the exactly same manner even in a case where the projection formed on the surface of the sintered compact material and the recess formed on the inner surface of the hermetically sealed space are engaged with each other.

One specific example will be described below for the cathode structure according to the third embodiment of the present invention.

Discharge lamp: Digital cinema xenon lamp

Electrical properties: Current is 160 A to 170 A, and rated power is approximately 7000 W Outer diameter of cathode: ϕ12 mm Entire length: 20 mm Dimension of front end part: Tapered angle is 40°, and front end diameter is 0.6 to 1.0 mm Gas pressure: Approximately 1.0 MPa in state of static pressure (pressure during lighting is estimated to be 5.0 MPa)

Sintered compact material: Emitter is cerium oxide

Cerium oxide powder and tungsten powder are mixed, placed in a die, and pressurized to create a powder compact having a circular column shape. The powder compact then undergoes the preliminary sintering at a temperature of approximately 1000 degrees C., and fired at 1500 degrees C. to 1800 degrees C., which is around the recrystallization temperature, to produce the sintered compact material. The male screw is made on the side surface of the sintered compact material by the cutting process with a lathe.

As described above, in the third embodiment of the present invention, the sintered compact material has the projection on the outer surface thereof, the hermetically sealed space of the cathode has the recess in the inner surface thereof, and the projection is engaged with the recess. Thus, the contact between the sintered compact material and the main body part or the front end part is maintained at certain portions of the recess and the projection even if the sintering of the sintered compact material progresses and the sintered compact material shrinks during the lighting of the lamp. The heat transmission is smoothly carried out from the main body part or the front end part to the sintered compact material through such contacting portions. The emitter diffuses from the sintered compact material to the main body part or the front end part in a reliable manner, and the supply of the emitter to the front end part does not delay.

REFERENCE NUMERALS AND SYMBOLS

1: Discharge lamp
2: Luminous tube
3: Cathode
31: Main body part
32: Front end part
33: Hermetically sealed space
33*e*: Recess (female screw)
34: Sintered compact material
34*a*: Front end face
34*b*: Rear end face
34*c*: Tapered portion
34*d*: Front end portion
34*e*: Projection (male screw)
35: Pressing member
4: Anode

The invention claimed is:

1. A discharge lamp comprising a cathode and an anode facing each other in a luminous tube, the cathode including a main body part and a front end part joined to a front end of the main body part, the main body part and the front end part being made from a high melting point metal material not including thorium, a first emitter being contained in the front end part, a sintered compact material being buried in a hermetically sealed space formed in at least one of the main body part and the front end part, the sintered compact material containing a second emitter (excluding thorium) at a concentration higher than that of the first emitter contained in the front end part, and a front end of the sintered compact material being brought into contact with the front end part.

2. The discharge lamp according to claim 1, further comprising a pressing member on a rear end of the sintered compact material in the hermetically sealed space, the pressing member being configured to press the sintered compact material toward the front end part.

3. The discharge lamp according to claim 2, wherein the pressing member is made from a high melting point material having a greater expansion rate than the main body part and the front end part.

4. The discharge lamp according to claim 3, wherein each of the main body part and the front end part is made from a material having tungsten as a main component; and the pressing material is made from a high melting point metal including tantalum (Ta), niobium (Nb), molybdenum (Mo), rhenium (Re), osmium (Os), and iridium (Ir) or an alloy thereof, or an oxide selected from magnesium oxide (MgO), aluminum oxide ($Al_2O_3$), calcium oxide (CaO), zirconium oxide ($ZrO_2$), yttrium oxide ($Y_2O_3$), and hafnium oxide ($HfO_2$).

5. The discharge lamp according to claim 2, wherein the pressing member has a spring shape, and is made from a high melting point metal, including as tungsten (W), tantalum (Ta), niobium (Nb), molybdenum (Mo), rhenium (Re), osmium (Os), and iridium (Ir), or an alloy thereof.

6. The discharge lamp according to claim 1, wherein the sintered compact material has a tapered portion, and a diameter of the tapered portion increases toward the front end part.

7. A discharge lamp comprising a cathode and an anode facing each other in a luminous tube, the cathode including a main body part and a front end part joined to a front end of the main body part, the main body part and the front end part being made from a high melting point metal material not including thorium, a first emitter being contained in the front end part, a sintered compact material being buried in a hermetically sealed space formed in at least one of the main body part and the front end part, the sintered compact material containing a second emitter (excluding thorium) at a concentration higher than that of the first emitter contained in the front end part, and a projection extending in a circumferential direction being formed on an outer surface of the sintered compact material, a recess extending in a circumferential direction being formed on an inner surface of the hermetically sealed space, the projection and the recess engaging with each other.

8. The discharge lamp according to claim 7, wherein the projection on the outer surface of the sintered compact material is a male screw, the recess on the inner surface of the hermetically sealed space is a female screw, and the male screw is threadedly engaged with the female screw.

* * * * *